US006344795B1

(12) United States Patent
Gehlot

(10) Patent No.: US 6,344,795 B1
(45) Date of Patent: Feb. 5, 2002

(54) METHOD AND APPARATUS FOR GENERATING TEMPERATURE BASED ALERTING SIGNALS

(75) Inventor: Narayan Lal Gehlot, Sayreville, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/421,127

(22) Filed: Oct. 19, 1999

(30) Foreign Application Priority Data

Aug. 17, 1999 (MY) ..... PI 9903522

(51) Int. Cl.[7] ..... G08B 21/00

(52) U.S. Cl. ..... 340/540; 340/7.58; 340/407.1; 340/573.1; 340/640; 340/691.1; 340/825.19

(58) Field of Search ..... 340/691.1, 691.3, 340/401.1, 401.2, 825.19, 825.46, 573.1, 588, 589, 640, 965, 407.1, 7.58, 7.6, 7.61, 7.62; 607/96; 600/521, 550; 338/59; 219/211, 212, 217

(56) References Cited

U.S. PATENT DOCUMENTS

| | | | | |
|---|---|---|---|---|
| 4,679,561 A | * | 7/1987 | Doss | 128/422 |
| 5,160,828 A | * | 11/1992 | Olsen | 219/211 |
| 5,582,757 A | | 12/1996 | Kio et al. | 219/548 |
| 5,619,181 A | | 4/1997 | Murray | 340/407.1 |
| 5,640,461 A | | 6/1997 | Ebert et al. | 381/188 |
| 5,861,686 A | | 1/1999 | Lee | 310/36 |
| 6,181,237 B1 | * | 1/2001 | Gehlot | 340/407.1 |

* cited by examiner

*Primary Examiner*—Jeffery Hofsass
*Assistant Examiner*—Son Tang

(57) ABSTRACT

An apparatus for providing a temperature based alerting signal to a user to alert the user to the occurrence of a particular or predetermined event. The temperature based alerting device may be incorporated into jewelry, garments, or a releasable strap and includes at least one spot heating element that is maintained in substantial contact with the user's skin. Upon detected occurrence of the predetermined event, as for example an incoming telephone call or page, the user is silently alerted by a change in the temperature of the spot heating element in contact with the user's skin. Subsequent action by the user, as for example answering of the incoming call or page, causes the temperature based alerting device to reset to an initial, non-alert state.

19 Claims, 7 Drawing Sheets

METHOD AND APPARATUS FOR GENERATING TEMPERATURE BASED ALERTING SIGNALS

BACKGROUND OF THE INVENTION

1. Field of the Invention

The present invention relates to alerting devices, and more particularly to a temperature based alerting device for obtaining a user's attention upon the occurrence of a predetermined event.

2. Description of the Related Art

The use of wireless communication is increasing at an exponential rate, and as such there have been many attempts among the service providers and manufacturers of the hardware implemented in the wireless systems to provide options to the users that enable more convenient and more user friendly and discrete access to the services. Among these attempts have been the implementation of other methods for alerting the user of the occurrence of a particular event and more specifically, the occurrence of an incoming communication signal. For example, with radio paging devices, the user generally has two options for setting the alert type when an incoming page is received; (i) an audible tone to indicate the presence of an incoming page or alternatively, (ii) a vibration mode to vibrate the device when the incoming page is being received. The vibration mode of the radio pager serves the same function of obtaining the user's attention when an incoming page is received but does so in a silent manner so as to not disturb the user or persons surrounding the user when the page is received.

Some wireless telephones also provide a similar vibration mode for indicating the presence of an incoming telephone call. The vibration mode has been implemented into these devices primarily to provide the user with the option of turning off the audible tones generated by the radio pager or wireless telephone to prevent inconvenient audible disturbances in a variety of different places. Examples of these places would be office meetings, libraries, and any other place or circumstance that the user deems appropriate to eliminate the audible tones generated by the respective devices.

U.S. Pat. No. 5,861,686 to Lee discloses a device for generating waking vibrations or sounds. The device is implemented into alarm watches or in communications equipment such as cellular pagers or phones. The device utilizes an electromagnet, a element and a first and second set of vibration members in a ring case. These elements are connected to the printed circuit board PCB of the device (e.g. watch, phone or pager) and together enable the selective generation of vibratory motion when the device receives an incoming call, or in the case of a watch for providing an alarm function.

U.S. Pat. No. 5,619,181 to Murray discloses a vibratory alerting device with audible sound generator. The alerting device simultaneously generates a vibration alert and an audible alert to notify the user as to the presence of an incoming call on a portable communication device such as a pager or wireless telephone.

As mentioned previously, the use of an audible alert signal can be undesirable when the user is located in place where an audible alert signal would be considered an interruption. In addition, the devices used to implement a vibratory alert signal in a communication device are generally bulky in nature and have mechanical moving parts which require additional space within the device and thereby increases the overall size of the device.

Furthermore, all of the existing alerting devices (e.g., audible and vibratory) are contained within the communication device (i.e., phone or pager) and therefor require the user to be carrying the same in order to receive the alerting signal.

It would be advantageous to provide a more discrete alerting device that is not physically connected or disposed within the user's communication device. This would enable the user to be alerted as to the presence of an incoming communication signal without requiring them to carry the communication device.

SUMMARY OF THE INVENTION

In accordance with a preferred embodiment of a invention, the method for generating a temperature based signal for alerting a user to the occurrence of a predetermined event comprises: providing a temperature based alerting device having at least one heating element in contact with the user's skin; initializing the temperature based alerting device to a predetermined temperature; setting a temperature change limit for the temperature based alerting device; changing the temperature of the heating element of the temperature based alerting device upon occurrence of the predetermined event; and resetting the temperature of the heating element of the temperature based alerting device when the user has responded to the occurrence of the predetermined event.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1A:
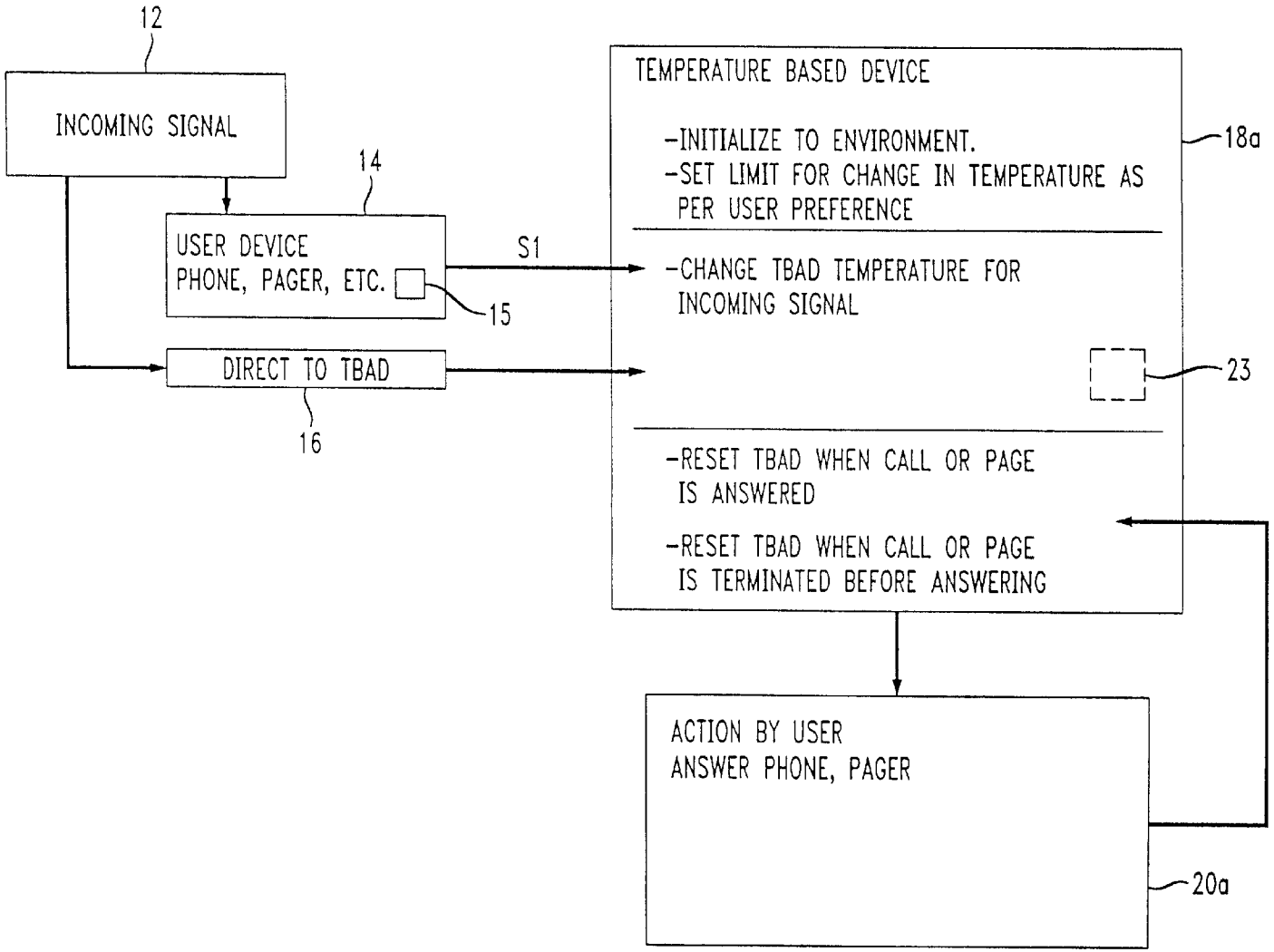
FIG. 1*a* is a block diagram of a method for generating temperature based alerting signals in accordance with an embodiment of the present invention.

A method for use in an illustrative apparatus shown in FIG. 1*a* of a temperature alerting signal device according to a first embodiment of the present invention. An incoming signal 12 is received from a remote or outside source and is applied to the user device 14. The user device is in this embodiment a wireless device such as a pager, cellular telephone, or any other known device that receives wireless/attention drawing alert-type incoming signals and alerts the user upon receipt of those signals. This alert to the user is generally performed by providing an audible signal, or a predominant vibration when an audible signal is inappropriate or not desired.

User device 14 is modified to include an inserting device 15 that disables the audible ringing or paging signal upon receipt of incoming signal 12 and generates one or more predetermined signals S1, or a set of predetermined signals S1, to activate temperature based alerting device 18*a*. Signal S1 may by way of illustration be a pulse width modulation (PWM) signal of a fixed predetermined frequency, or short pulses of the predetermined frequency. The frequency range for such signals can be, for example, 45–49 MHz or 800 MHz through the 900 MHz range. Inserting device 15 may be, for example, an oscillator circuit of an allowable non-interfering frequency using a timer chip, and signal S1 can be generated with a simple LRC combination circuit or a timer IC circuit. The signal strength of S1 should be sufficient to reach the temperature based alerting device which may be attached to the user's body parts, as needed.

Inserting device 15 is shown integrated into user device 14, although it is also contemplated that inserting device 15 be externally provided and attachable by a separate connector engageable with existing connectors on the user device, such for example, as the battery charger connection, an earphone for hands free operation, and an IR port.

Figure 8:
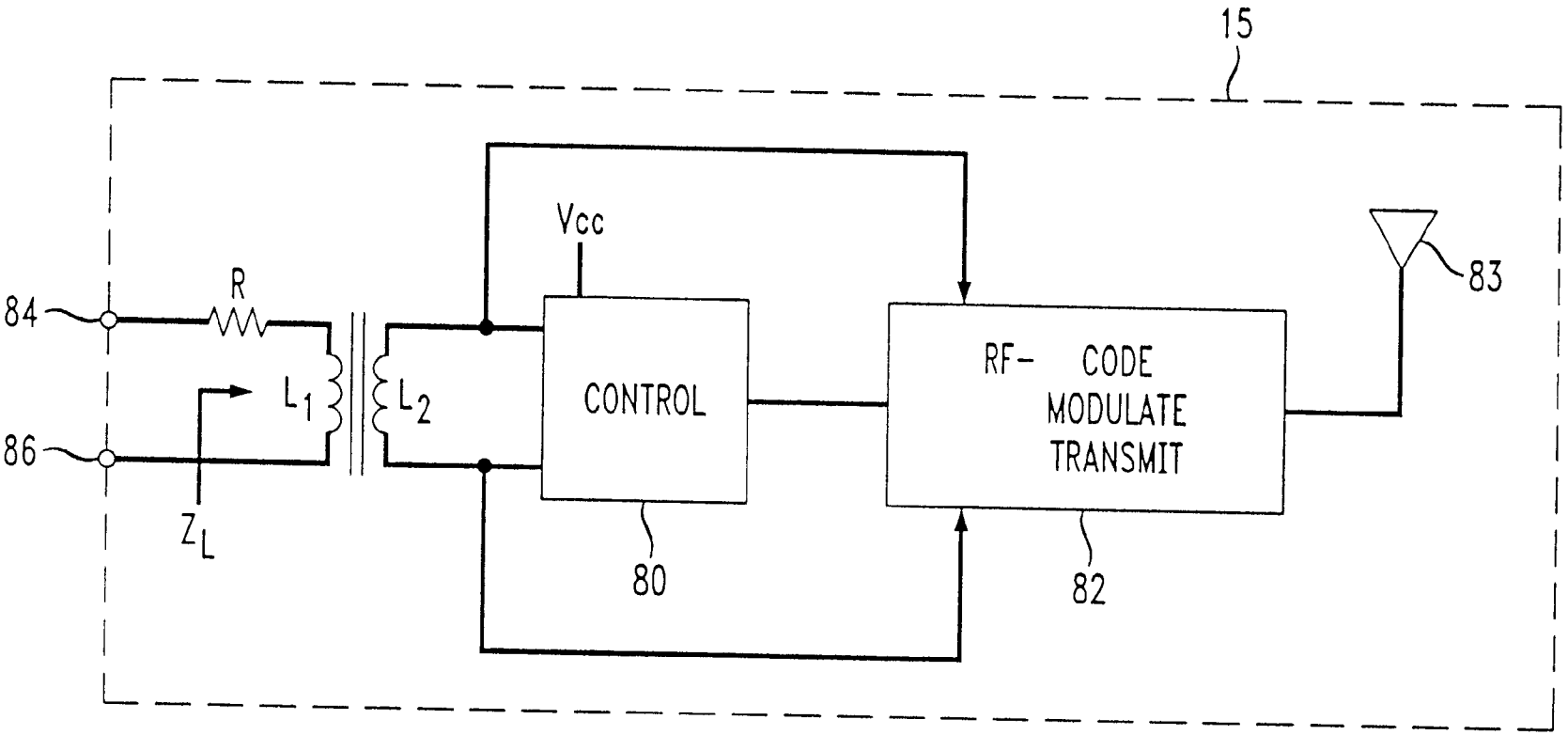
FIG. 8 is a schematic block diagram of an inserting device according to an embodiment of the present invention.

FIG. 8 shows an exemplary embodiment of inserting device 15 according to the invention. When incoming signal 12 is detected by user device 14, it is provided to inserting device 15 via terminals 84 and 86. The presence of the ringer current on terminals 84 and 86 causes an inductive coupling between inductors L1 and L2. Once coupled, the current flows to control 80 which electronically disables the ringer within user device 14 and further causes the RF device 82 to modulate and transmit control signal S1 via antenna 83 to the alerting device 18*a*. Control 80 can be any suitable known processing device. In another embodiment, control 80 can enable inserting device 15 to generate signal S1 in conjunction with the audible ringing of user device 14.

In an external example previously mentioned, terminals 84 and 86 can be mechanically coupled to an earphone jack of the user device. Generally, the mechanical coupling of a jack to the ear phone input of the user device will cause the same to mechanically disable the earphone speaker, and thereby disables the audible alert signal generated by the user device. Upon receiving incoming signal 12, the ringer current ordinarily broadcast through the earphone speaker will pass through the earphone jack and cause the inductive coupling of inductors L1 and L2 as described above. Thus, inserting device 15 can be added to user device that is not designed to incorporate the same.

In accordance with an embodiment of the present invention, the temperature based alerting device (TBAD) 18*a* is connected with user device 14 via a wireless connection, such for example, as radio frequency (RF) signals. The TBAD 18*a* is external and separate from the user device and includes at least one heating element 23 (FIG. 4) that is located in physical contact with the user's person (preferably the skin) and is initially set to a temperature substantially equal to the ambient environment. Heating element 23 is a sensor/element/actuator that is capable of sensing the temperature of it's ambient environment, heating up in response to an applied signal, and actuating another electronic component (if desired) based on its increase in temperature. The temperature change limit is contemplated to be in the range of ±10° F. from the ambient temperature. The response time of the heating elements 23 to change temperature is dependent on the ambient temperature conditions. For example, in cold weather heating elements 23 will take longer to heat up. This may require that the upper limit of the temperature change be increased to enable a large change in the initial temperature. When the ambient temperature is warm, the response time will be faster. The one or more heating elements 23 or heating strip 42 (FIGS. 6*b* and 7) may be, for example, a heating strip as known in the art and as disclosed, for example, in U.S. Pat. No. 5,582,757.

The external disposition of the TBAD 18*a* enables a more discrete alerting signal to be provided to the user, and provides the user with the option of not carrying the user device 14 and yet continuing to be notified as the presence of an incoming communication signal 12.

In the embodiment of FIG. 1*a*, when incoming signal 12 is received by user device 14, inserting device 15 disables the ringer and sends control signal S1 via inserting device 15 to the TBAD 18*a* to cause it to change (i.e., preferably increase or possibly decrease) the temperature of the connected heating elements. The amount of variation or limit on the temperature change (i.e. upper limit) can be predetermined or set by the user prior to use of the TBAD 18*a*. Since the heating elements 23 are in physical contact with the user's person, with the resulting temperature changes the user is alerted to the presence of incoming signal 12, and the user can then answer the phone or page (20*a*). Once the user responds to the incoming signal by either answering the call or acknowledging the incoming page, TBAD 18*a* resets itself to the initially set temperature.

In another embodiment of the invention, the TBAD 18*a* is configured to directly receive 16 or share the incoming signal 12 with user device 14. Thus, upon receipt of incoming signal 12, TBAD 18*a* can respond immediately as opposed to requiring that user device 14 provide control signal S1 via inserting device 15 to TBAD 18*a* to indicate the presence of coming signal 12. This embodiment enables the simultaneous receipt of the incoming signal by both the user device and the alerting device 18, thereby eliminating the need for the user device to subsequently send an RF signal to TBAD 18*a* after receiving an incoming signal 12 and enable a ringer volume of the user device 14 to be set to zero, a minimum or non-audible level.

Figure 2:
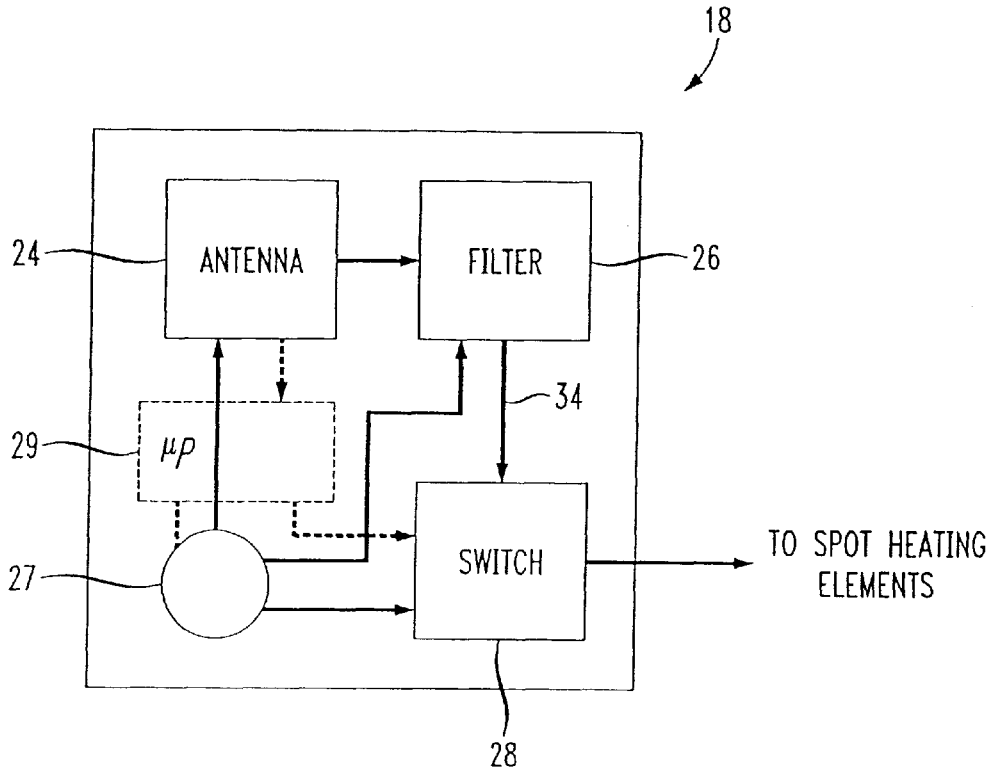
FIG. 2 is a block diagram of the circuitry for the temperature based alerting device according to an embodiment of the invention.

FIG. 2 depicts a block diagram of TBAD 18 constructed according to an embodiment of the invention. TBAD includes an antenna 24 for receiving the incoming signal either from the user device 14 or directly 16 from the source of incoming signal 12. Antenna 24 is preferably a thin film antenna internally arranged within TBAD 18 so that the TBAD can be implemented in various different structures as discussed hereinbelow. The received incoming signal is filtered by filter 26 to reduce noise in the operating bandwidth. The filtered signal is then fed to switch 28 which activates spot heating elements 23 (FIG. 4) disposed in contact with the user's skin. Switch 28 may be, for example, an operational amplifier, a relay, or other electronic or mechanical switch for selectively passing battery power to the spot heating elements, or corresponding circuitry to cause the same to selectively heat up. In other contemplated embodiments, TBAD 18 can include a microprocessor 29 that is connected to antenna 24, battery 27 and switch 28. Microprocessor 29 is operable to the monitoring of the ambient temperature as a reference temperature input and to also enable a monitoring embodiment of the invention (described below with reference to FIGS. 5*a* and 5*b*) by determining the cyclic or repetitive presence of the incoming signal and sending a control signal to switch 28 in the detected absence of incoming signal 12.

A battery 27 is connected to a preamplifier (not shown) of the antenna 24, filter 26, microprocessor 29 and switch 28 to provide operating power to these devices and a current signal to heating elements 23 in response to the closing of switch 28 which causes the heating elements to heat up. Battery 27 is a miniature battery known in the art such as, for example, a solid state rechargeable thin film battery, a planar micro battery, lithium coin cells, thin film lithium battery, etc. The type of battery implemented and size thereof is a matter of design choice, and is dependent on the article in which alerting device 18 is incorporated.

Figure 3:
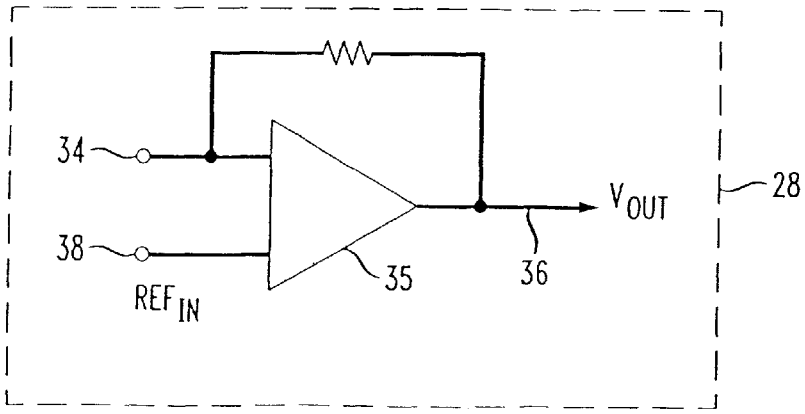
FIG. 3 is a schematic diagram of an operational amplifier implementation of the switch of the temperature based alerting device according to an embodiment of the invention.

FIG. 3 is a schematic diagram of an exemplary operational amplifier configuration of switch 28. Operational amplifier 35 has a predetermined gain, a reference input 38 that is connected to the input reference signal to obtain an ambient temperature reference input or a preset reference temperature to provide a reference input, and another input 34 that receives a control signal via filter 26 (FIG. 2). The input reference signal applied to reference input 38 can be, for example, a predetermined reference signal generated and stored by microprocessor 29, preset according to a particular design choice for a predetermined application, user set or dynamically set by microprocessor 29 based on the ambient temperature and the user's external body temperature. Upon receipt of the incoming signal or a control signal in the form of a predetermined frequency comprised of pulses or a continuous signal via input 34, operational amplifier 35 provides an output current signal 36 that is fed to the spot heating elements 23 (FIG. 4) to heat the same. Upon discontinuation of the signal applied to input 34, opamp 25 discontinues its current signal output, and the heating elements 23 are thus deactivated. The discontinuation of the incoming signal can be a result of the user answering the call or page, or of the incoming caller terminating the call before the user answers it.

In accordance with another aspect of the present invention, temperature based alerting device 18 (FIG. 2) can monitor the ambient temperature so as to provide the reference signal input 29 for reference input 38 of switch 28. To save battery power, the monitoring of the ambient temperature can be performed during the start of the transmission of the S1 signal to TBAD 18; thus, only during activation of the TBAD circuitry will ambient temperature monitoring take place. Alternatively, where switch 28 is a relay or other mechanical switch, microprocessor 29 can receive and process the monitored ambient temperature when providing the control signal to switch 28 to activate heating elements 23.

Figure 4:
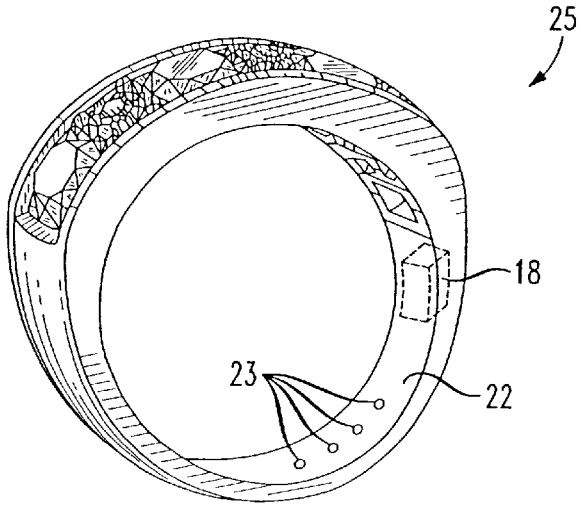
FIG. 4 is a perspective view of a jewelry ring incorporating the device for generating temperature based alerting signals according to an embodiment of the invention.
Figure 6A:
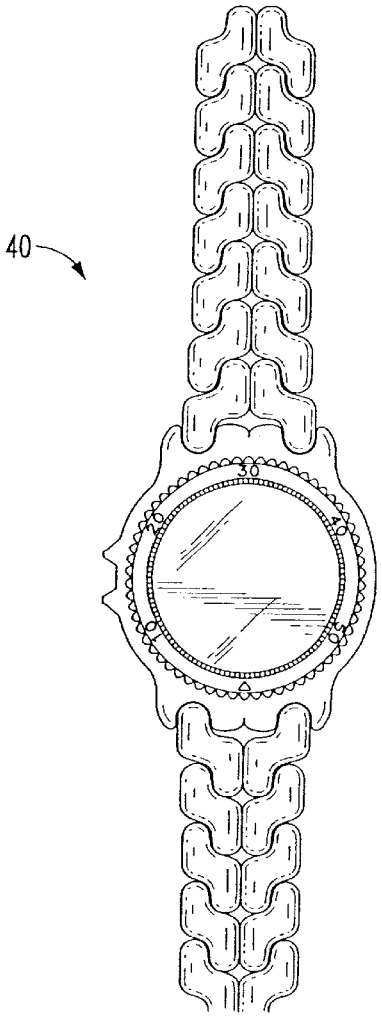
FIG. 6*a* is a top view of a wristwatch incorporating the device for generating temperature based alerting signals according to an embodiment of the invention.
Figure 6B:
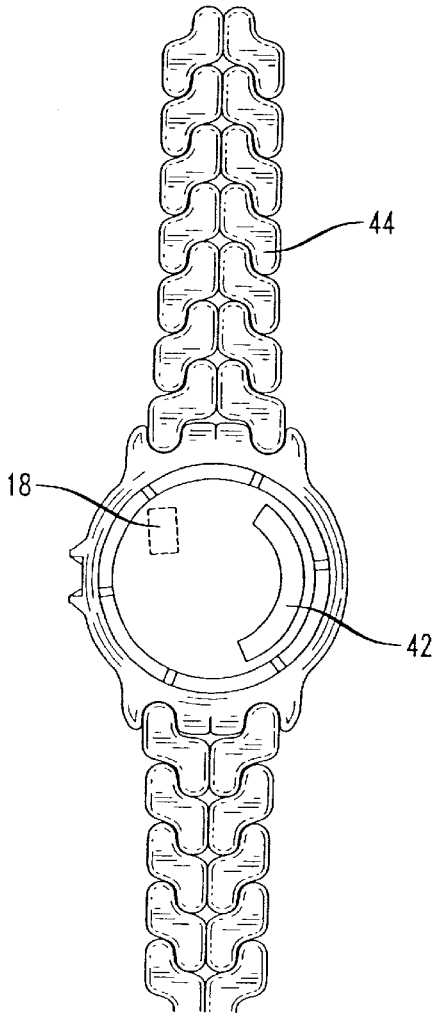
FIG. 6*b* is a bottom view of a wristwatch incorporating the device for generating temperature based alerting signals according to an embodiment of the invention.
Figure 7:
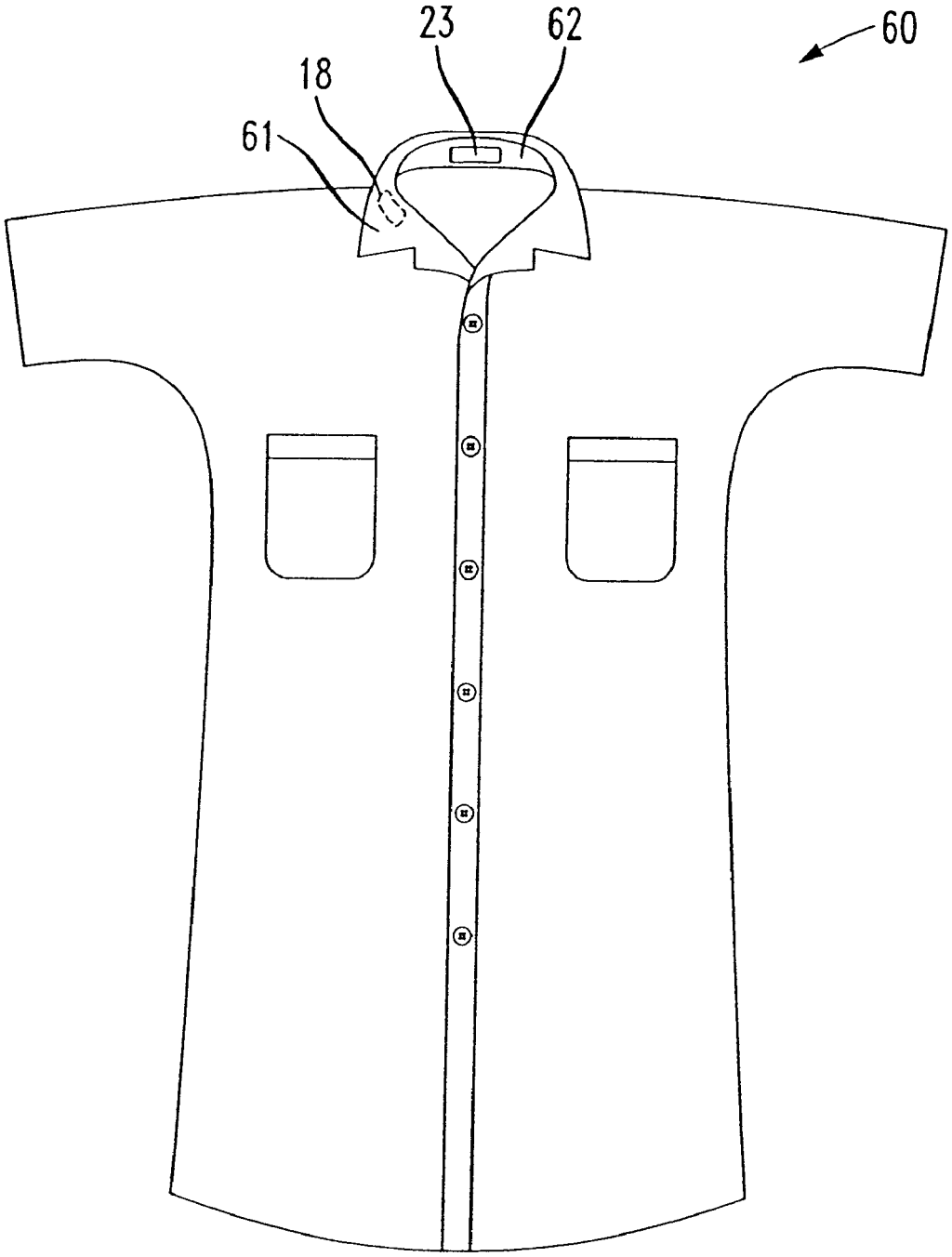
FIG. 7 is a front view of an article of clothing incorporating the temperature based alerting device according to an embodiment of the present invention.

Referring now to FIGS. 4, 6*b* and 7, the TBAD 18 can be implemented and incorporated in many different articles and objects such for example as a jewelry ring (FIG. 4), a wristwatch (FIG. 6*b*) and an article of clothing (FIG. 7). In addition, it is contemplated that TBAD 18 be a self-contained device that can be removably fastened or attached to different users. In the fixed position configuration, the size and shape of the object in which the TBAD 18 is implemented is a matter of design choice and is left to the imagination of fashion and jewelry designers and the like. Other objects for housing TBAD 18 as currently contemplated include finger rings, ear rings, bangle bracelets, shirts, pants, shoes, wrist watches, pocket watches, neck-ties, neck-tie pins, anklets, belt buckles, dress buttons, pens and necklaces etc.

Shown in FIG. 4 is a ring 25 incorporating therein the TBAD 18, with a plurality of spot heating elements 23 disposed on the inner band 22 of ring 25. Heating elements 23 are connected to TBAD 18 and heat up in response to an output current from TBAD 18 as explained above. Since silver and gold are among the best conductors of heat, heating elements 23 can optionally be eliminated in the contemplated embodiments using gold or silver jewelry and the actual silver or gold of the jewelry can be used to generate the temperature change by simply connecting the output current signal to the gold or silver of the respective piece of jewelry.

FIGS. 6*a* and 6*b* show a wristwatch 40 incorporating the TBAD 18 therein, and a heating strip or element 42 disposed on the underside of the watch (FIG. 6*b*). When watch 40 is on a user's wrist, element 42 is in contact with the user's skin and can thereby alert the user by heating up when an incoming call is detected. Heating strip or element 42 can be disposed on the underside of the band 44 or any other conveniently located site that enables contact with the user's skin.

FIG. 7 depicts an exemplary embodiment in which an article of clothing houses the temperature based alerting device 18 of the invention. Shirt 60 has the alerting device 18 disposed under the collar 61 and the heating strip 42 on the back 62 of collar 61 such that the heating strip is maintained in contact with the user's neck when the shirt is worn. The position of heating strip 42 and TBAD 18 can of course be varied for user or designer preference so long as heating strip 42 lies in contact with the user's skin when shirt 60 is worn.

Figure 1B:
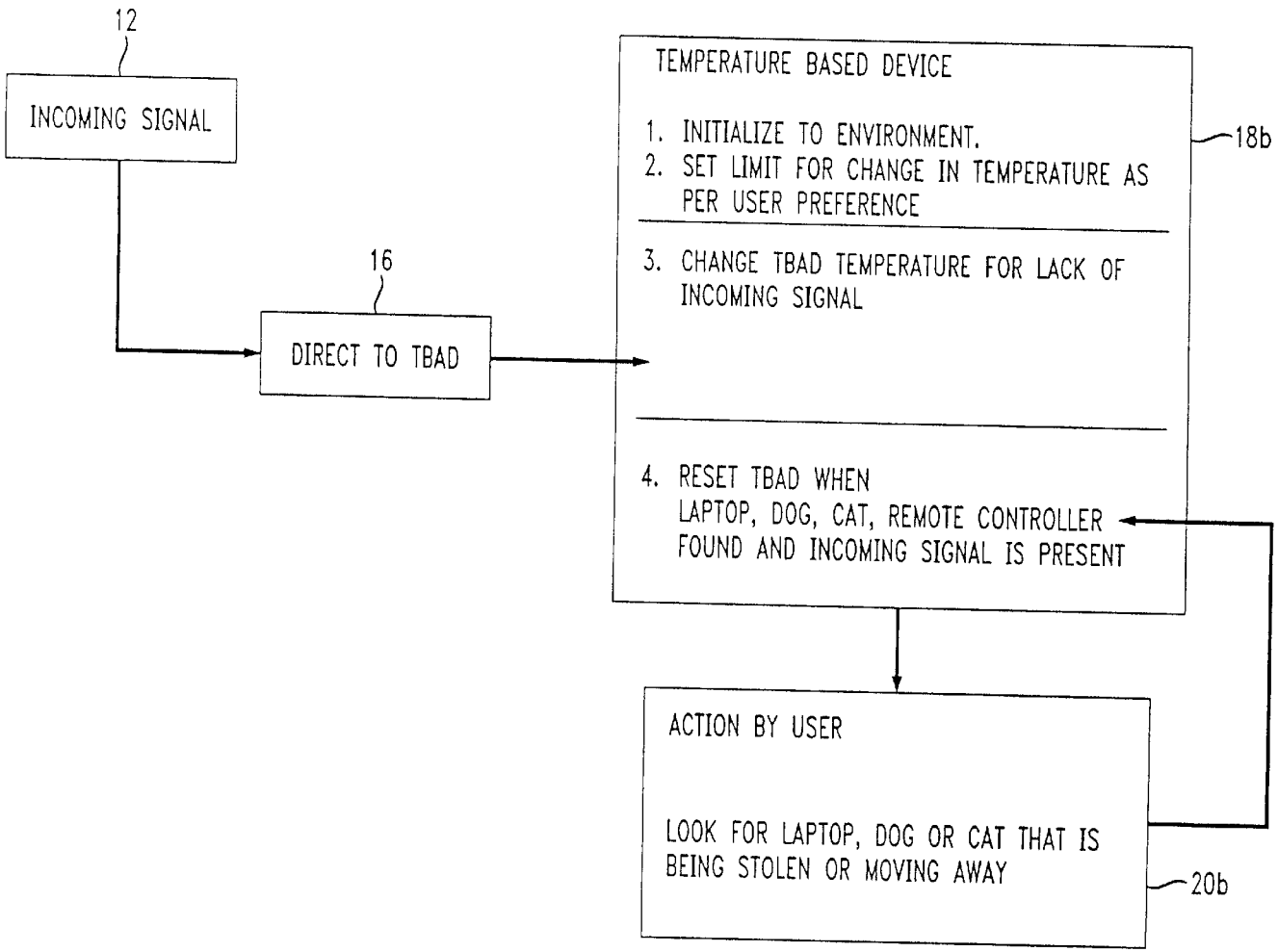
FIG. 1*b* is a block diagram of a method for generating temperature based alerting signals in accordance with another embodiment of the invention.

In a further embodiment diagrammatically shown in FIG. 1*b*, TBAD 18*b* may be used to alert a user as to the presence, or more particularly the absence, of an object, animal or person. For example, a remote transmitter can provide TBAD 18*b* with an RF signal on a cyclic or repetitive basis. In this embodiment, the user device 14 (FIG. 1*a*) is not required for communicating the detected presence of incoming signal 12. As described hereinabove, TBAD 18*b* may include a microprocessor 29 (FIG. 2) that enables monitoring of the presence of the RF signal (i.e. of incoming signal 12). When the presence of the RF signal is not detected for a predetermined period of time (e.g. 1–30 seconds), TBAD 18*b* will alert the user by changing the temperature of the attached heating elements. The lack of detection of the incoming RF signal may for example be the result of the movement of the object, person, or animal from which the transmission emanates to a location beyond a predetermined range. With the user thus alerted to the lack of detection of the RF signal, a search for the transmitting device can be initiated to determine its location. When the user is once more within the range of the transmitting device, the TBAD 18*b* again receives the RF signal and resets itself to return the heating elements 23 to their initial temperature. Examples of contemplated objects or articles for tracking include a portable computer, remote control devices, and any other readily movable object that the user wishes to monitor. This presence or proximity monitoring embodiment can also be used to monitor the proximity of a child or animal provided with a transmitter that transmits the RF signal 12 for monitoring by TBAD 18*b*.

Figure 5A:
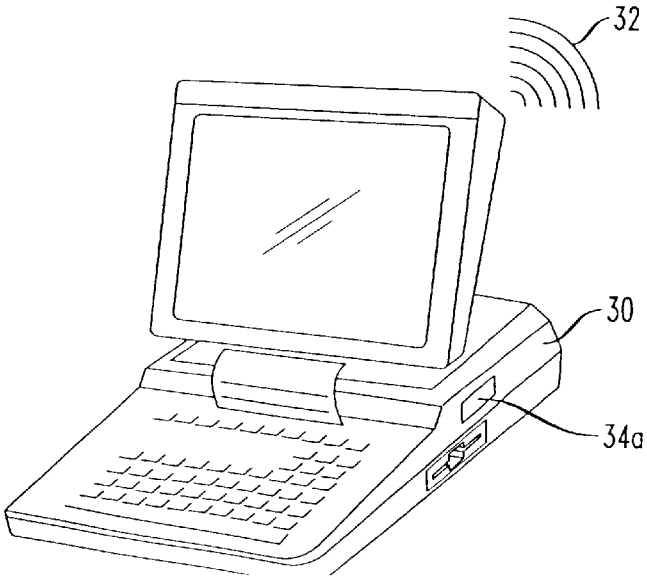
FIG. 5*a* is a perspective view of a computer implementing into the device for generating temperature based alerting signals according to an embodiment of the invention.

Referring now to FIG. 5*a,* a transmitter 34*a* is shown attached to a portable laptop type computer 30. Transmitter 34*a* can be externally attached to computer 30 or disposed internally therewithin so that it transmits RF signals 32 of a predetermined frequency and format (e.g. pulse, continuous, etc.) that TBAD 18*b* is adapted to receive. The transmission of signals 32 can be intermittent, or cyclic based on a predetermined timing scheme. In this embodiment, TBAD 18*b* receives the intermittent or cyclic signals and only generates a current signal to activate the heating elements 23 when the intermittent or cyclic signals are not received for a predetermined period of time. Through the transmission of RF signals at predetermined intervals the TBAD 18*b* performs a monitoring function for alerting the user as to the absence of the RF signals and, thereby, as to the absence of the object, person or animal being monitored.

Figure 5B:
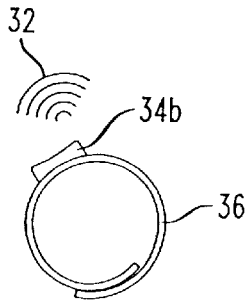
FIG. 5*b* is a plan view of a releasable strap having a transmitter for use in the generation of temperature based alerting signals according to an embodiment of the invention.

FIG. 5*b* depicts a strap 36 having a transmitter 34*b* mounted thereon. Strap 36 can be releasably attached to an object, child or animal to provide the remotely-originating transmitting signals 32 to TBAD 18*b*. Thus, when transmitter 34*b* is attached to an animal or a child via strap 36, the person watching after the animal or child can monitor their presence within a specified range of the transmitter 34*b* and TBAD 18*b*. In this embodiment, TBAD 18*b* may be implemented as in a piece of jewelry or clothing or in a releasable device worn or caused by the user, and the transmitter 34*b* can be attached to the object, animal, or person to be monitored in any convenient manner.

It is thus contemplated herein that TBAD be incorporated into many different known articles or items where its size and shape can be configured in accordance with the desired application. Illustration examples of such articles include any and all types of jewelry such, for example, as finger rings, earrings, necklaces, bracelets and wrist watches; clothing such, for example, as hats, caps, shirts, pants, shoes, shoe soles, and socks; and other items such as pens and pencils. TBAD 18 may also be configured to be portable for ready releasable transfer from one user or to article to another.

While there have shown and described and pointed out fundamental novel features of the invention as applied to preferred embodiments thereof, it will be understood that various omissions and substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same result are within the scope of the invention. It is the intention, therefore, to be limited only as indicated by the scope of the claims appended hereto.

I claim:

1. A method for generating a temperature based alerting signal for alerting a user to an occurrence of a predetermined event, comprising the steps of:

providing a temperature based alerting device having a heating element disposed in substantial contact with the user's skin;

initializing, prior to occurrence of the predetermined event, the temperature based alerting device to a predetermined initial temperature;

setting a temperature change limit for the temperature sensitive alerting device;

changing the temperature of said heating element from the initial temperature to a second temperature greater than the initial temperature upon detection by the alerting device of the occurrence of the predetermined event to alert the user to the occurrence of the predetermined event; and resetting the temperature of said heating element from the second temperature to the initial temperature when the user has responded to the alert of the occurrence of the predetermined event.

2. The method set forth in claim 1, wherein said predetermined event comprises receipt by the alerting device of an incoming communication signal from a remotely-disposed outside source, and wherein the user response comprises answering the incoming communication signal.

3. The method set forth in claim 2, wherein the incoming communication signal is designated for one of a wireless telephone and a paging device.

4. The method set forth in claim 3, further comprising the step of generating a wireless control communication signal for transmission by the one of the telephone and the paging device to the alerting device for activating the heating element to change its temperature from the initial temperature to the second temperature.

5. The method set forth in claim 2, further comprising the step of applying the incoming communication signal directly to the alerting device to cause it to change the temperature of the heating element from the initial temperature to the second temperature.

6. The method set forth in claim 1, further comprising the steps of:

providing a transmitting device remote from the alerting device for transmitting wireless communication signals on a predetermined repetitive basis; and monitoring at the alerting device receipt of the transmitted wireless communication signals;

said predetermined event comprising determining at the alerting device an absence of receipt of the transmitted wireless communication signals for a predetermined period of time, and wherein said user response comprises relocating the alerting device relative to the transmitting device so that the alerting device is within a transmitting range of the transmitting device for receipt of the communication signals by the alerting device.

7. The method set forth in claim 1, wherein said step of providing comprises incorporating the alerting device with the heating element integrally into a piece of jewelry wearable by the user.

8. The method set forth in claim 1, wherein said step of providing comprises incorporating the alerting device with the heating element integrally into an article of clothing wearable by the user.

9. The method set forth in claim 6, wherein said transmitter is provided for releasable attachment to one of an object, a person, and an animal for enabling the user to monitor a predetermined proximity of the object, person and animal to the user.

10. An apparatus for generating temperature based alerting signals to a user in response to an incoming communication signal designated for a wireless communication device, comprising:

a temperature based alerting device having a power source, a switch element coupled to said power source and a heating element coupled to said switch element, and disposable in contact with the user's skin; and means for applying a control signal to said alerting device in response to receipt by said means of the incoming communication signal to cause said switch element to close and apply an actuating signal to said heating element, said heating element being configured to heat up in response to of the applied actuation signal and thereby alert the user to the presence of incoming communication signal.

11. An apparatus in accordance with claim 10, wherein said alerting device further comprises an antenna for receiving said control signal.

12. An apparatus in accordance with claim 11, wherein said means for applying comprises an inserting device connected with the wireless communication device and operable for generating said control signal in response to said receipt of the incoming communication signal and for disabling an audible alert signal normally produced by the wireless communication device.

13. An apparatus in accordance with claim 12, wherein said alerting device further comprises a microprocessor for controlling operation of the alerting device.

14. An apparatus in accordance with claim 13, wherein the incoming communication signal is received directly by said antenna and defines said control signal, and wherein said microprocessor is operable for controlling said switch to close in response to the receipt of the incoming communication signal.

15. An apparatus in accordance with claim 13, wherein said switch element comprises an operational amplifier having a signal input for receiving said control signal, a reference input, and an output for outputting said control actuation signal to said alerting device.

16. An apparatus in accordance with claim 15, wherein said microprocessor is operable to provide a reference signal representing a reference temperature for application to said reference input.

17. An apparatus in accordance with claim 16, wherein said microprocessor is operable to monitor an ambient temperature of said alerting device and to apply the reference signal representing the monitored ambient temperature to said reference input.

18. An apparatus for generating temperature based alerting signals to alert a user to an occurrence of a predetermined event, comprising:

a temperature based alerting device having a power source, a switch element coupled to said power source and a heating element coupled to said switch element and maintainable in substantial contact with the user's skin;

transmitting means remote from said alerting device for transmitting communication signals to said alerting device on a repetitive basis; and means for controlling said switch element to close and thereby activate the heating element in response to a lack of receipt by the alerting device of the transmitted communication signals for a predetermined period of time.

19. An apparatus in accordance with claim 18, wherein said closing of the switch element applies a current signal to said heating element to cause, said heating element to heat up as a result of the applied current signal and thereby alert the user to the lack of receipt of the transmitted communication signals.

* * * * *